US010928024B2

(12) United States Patent
Huang et al.

(10) Patent No.: US 10,928,024 B2
(45) Date of Patent: Feb. 23, 2021

(54) IMITATION FLAME COMPONENT AND IMITATION FLAME LAMP

(71) Applicants: Guozeng Huang, Guangdong (CN); Chao Li, Guangdong (CN)

(72) Inventors: Guozeng Huang, Guangdong (CN); Chao Li, Guangdong (CN)

( * ) Notice: Subject to any disclaimer, the term of this patent is extended or adjusted under 35 U.S.C. 154(b) by 0 days.

(21) Appl. No.: 17/005,106

(22) Filed: Aug. 27, 2020

(65) Prior Publication Data

US 2020/0393102 A1 Dec. 17, 2020

(30) Foreign Application Priority Data

May 26, 2020 (CN) ..... 202020913197.9
Jul. 14, 2020 (CN) ..... 202021386665.8

(51) Int. Cl.
*F21S 10/04* (2006.01)
*F21V 23/00* (2015.01)
*F21Y 115/10* (2016.01)

(52) U.S. Cl.
CPC ..... *F21S 10/043* (2013.01); *F21V 23/004* (2013.01); *F21Y 2115/10* (2016.08)

(58) Field of Classification Search
CPC ..... F21S 10/04–046; F21V 23/004
See application file for complete search history.

(56) References Cited

U.S. PATENT DOCUMENTS 9,182,085 B2 * 11/2015 Haenen ..... F21V 29/75
9,739,432 B2 * 8/2017 Li ..... H05B 45/20
2014/0254148 A1 * 9/2014 Fournier ..... F21S 10/04 362/235
2015/0362141 A1 * 12/2015 Chen ..... F21S 9/02 362/183
2017/0130917 A1 * 5/2017 Yung ..... F21S 9/02
2018/0347772 A1 * 12/2018 Lin ..... F21S 6/001

FOREIGN PATENT DOCUMENTS

WO WO-2014165932 A1 * 10/2014 ..... H05B 45/20

* cited by examiner

*Primary Examiner* — Mariceli Santiago
(74) *Attorney, Agent, or Firm* — Shimokaji IP

(57) ABSTRACT

An imitation flame component includes a flame head body with a hollow structure and at least two illuminants. At least one side of the flame head body is provided with a projection surface for projecting light, the illuminants are configured inside the flame head body, the illuminants are arranged up and down respectively, and the light from the illuminants has an emitting direction facing toward the projection surface. Such an imitation flame component has a simple structure, convenient control and excellent imitation effect.

10 Claims, 6 Drawing Sheets

IMITATION FLAME COMPONENT AND IMITATION FLAME LAMP

FIELD OF THE INVENTION

The present invention relates to an imitation flame lamp, and more particularly to an imitation flame component and an imitation flame lamp having simple structure, convenient control and improved imitation effect.

BACKGROUND OF THE INVENTION

People usually use imitation flame lamps, such as imitation candles to imitate the flame burning effect to enhance the atmosphere of the surrounding environment. The existing imitation flame lamps generally mount a flame sheet on a lamp cap, and then configure an illuminant outside of the flame sheet to project the light emitted from the illuminant onto the flame sheet, and use a driving mechanism to drive the flame sheet to swing, so as achieve an imitation effect of imitating candle burning. However, the structure of the above-mentioned imitation flame lamp is complicated, the control is inconvenient, and the imitation effect of the existing imitation flame lamp is unsatisfactory.

SUMMARY OF THE INVENTION

One objective of the present invention is to provide an imitation flame component which has a simple structure, convenient control and excellent imitation effect.

Another objective of the present invention is to provide an imitation flame lamp which has a simple structure, convenient control and excellent imitation effect.

To achieve the mentioned above objectives, the present invention provides an imitation flame component including a flame head body with a hollow structure and at least two illuminants, wherein at least one side of the flame head body is provided with a projection surface for projecting light, the illuminants are configured inside the flame head body, the illuminants are arranged up and down respectively, and the light from the illuminants has an emitting direction facing toward the projection surface.

In comparison with the prior art, the flame head body of the present invention is provided with a projection surface, and two illuminants respectively arranged up and down are arranged inside the flame head body, and the light from the illuminants has an emitting direction facing toward the projection surface, so that a flame imitation effect can be shown on the projection surface. Furthermore, the flame imitation effect can be further improved by controlling the flicker of the two illuminants to simulate the flame burning. In addition, it's unnecessary to use a traditional manner of using a driving mechanism to drive the flame sheet to swing, the flame head body of the present application can be directly fixed, which simplifies the structure of the imitation flame component, the lamp holder and the driving mechanism, and the control is quite convenient and the cost is lowered.

Preferably, the projection surface is a plane.

Preferably, the projection surface is inclined.

Preferably, the projection surface has a width gradually decreased from down to up.

Preferably, two projection surfaces are configured at a front side and a rear side of the flame head body, respectively.

Preferably, the projection surface has a lower half that is provided with a strip-shaped projection layer which is extended upward from a lower edge of the projection surface.

Preferably, the light from the illuminants are respectively projected at an upper side and a lower side of the projection surface.

Preferably, a lower end of the flame head body is provided with a connecting part.

Preferably, the at least one side of the flame head body is extended upward from an upper edge of the flame head body to form a wall surface on which the projection surface is located.

Accordingly, an imitation flame lamp includes a lamp holder body, a power supply, a control circuit board, and the imitation flame component mentioned above, wherein the flame head body is fixed on the lamp holder body, the power supply and the control circuit board are configured into the lamp holder body, and the illuminants and the power supply are electrically connected to control circuit board, respectively.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

The present invention will be described in detail below with reference to the accompanying drawings and preferred embodiments.

Figure 1:
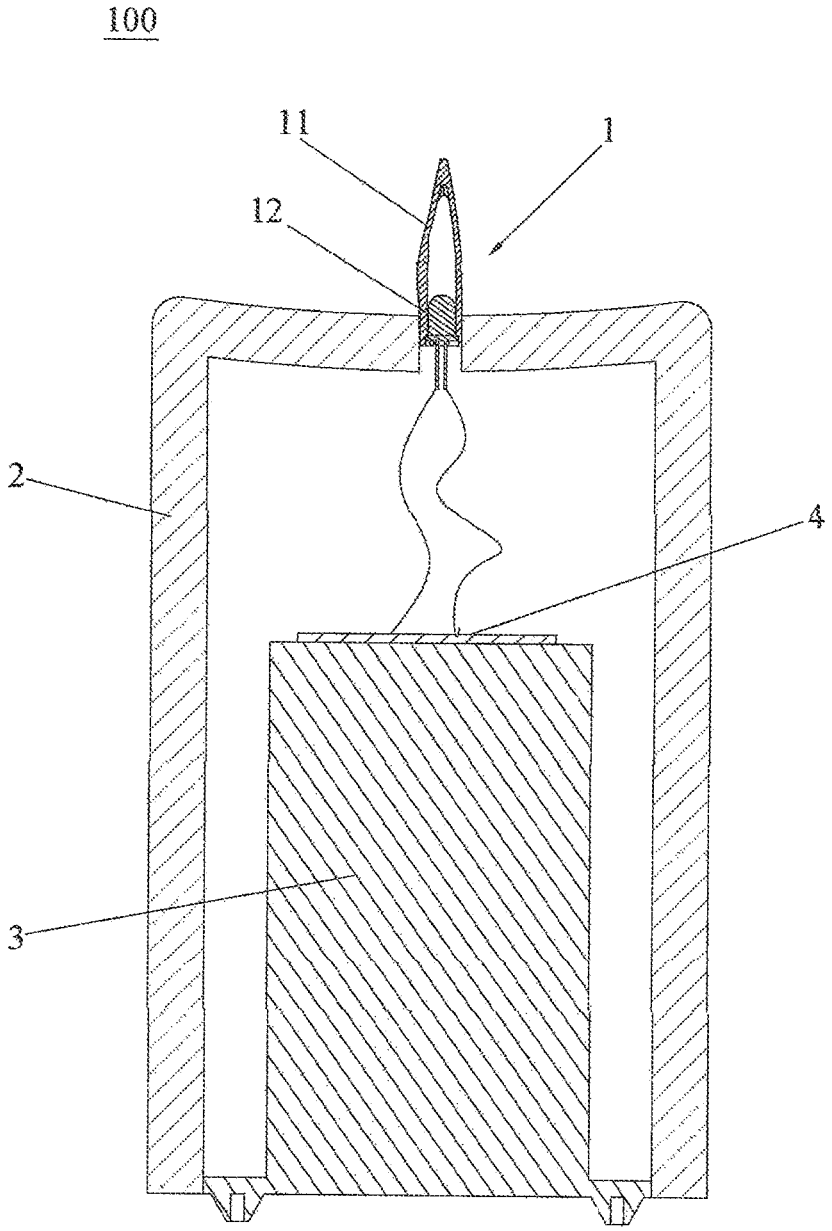
FIG. 1 is a schematic view of an imitation flame lamp according to a first embodiment of the present invention.
Figure 2:
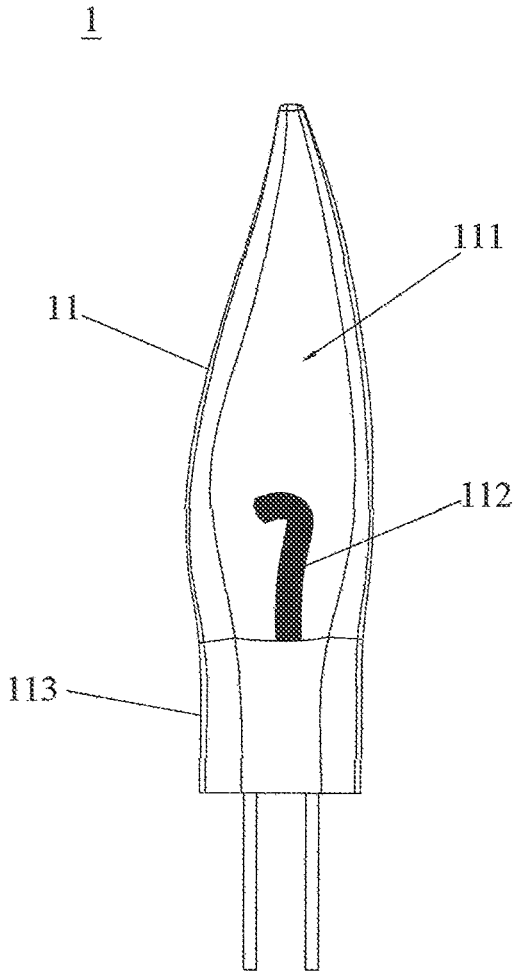
FIG. 2 is a schematic view of an imitation flame component according to a first embodiment of the present invention.
Figure 3:
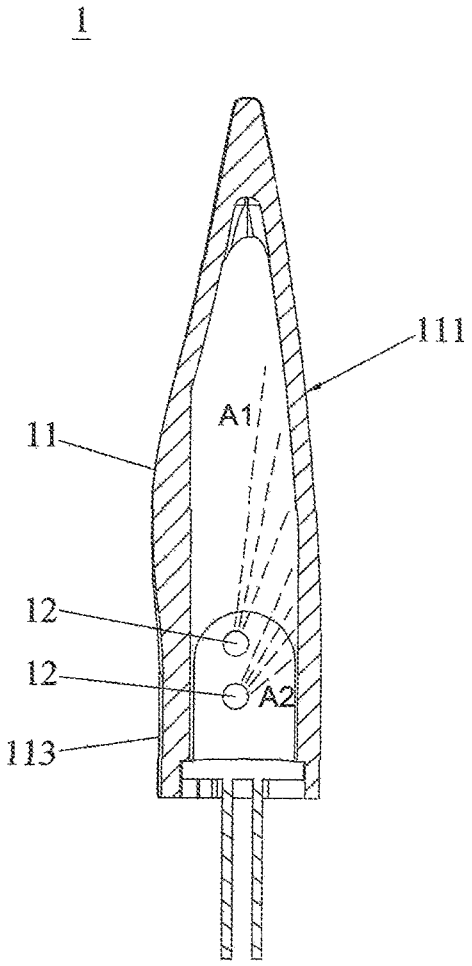
FIG. 3 is a sectional view of an imitation flame component according to a first embodiment of the present invention.

As illustrated in FIGS. 1-3, an imitation flame lamp 100 of the present invention includes an imitation flame component 1, a lamp holder body 2, a power supply 3 and a control circuit board 4. Specifically, the imitation flame component 1 includes a flame head body 11 with a hollow structure and at least two illuminants 12. In this embodiment, two illuminants 12 are included. The lamp holder body 2 can be made of candle oil, plastic or other materials. The flame head body 11 is made of a semi-transparent material, or a transparent material which surface is screen printed with a white layer, and the flame head body 11 is a PVC shell. The lower end of the flame head body 11 is provided with a connecting part 113 which is integrated with the flame head body 11. The connecting head 113 is fixed to the upper end of the lamp holder body 2 so that the upper end of the flame head body 11 is protruded from the lamp holder body 2. The power supply 3 and the control circuit board 4 are configured in the lamp holder body 2, and the illuminants 12 and the power supply 3 are electrically connected to the control circuit board 4, respectively.

As shown in FIGS. 2 and 3 again, at least one side of the flame head body 11 is provided with a projection surface 111 for projecting light. Specifically, the projection surface 111 is an inclined plane. The flame head body 11 has a largest central part and an upper end gradually narrowed. The two illuminants 12 are configured in the flame head body 11, and arranged up and down respectively, and the light from the illuminants 12 has emitting directions A1, A2 facing toward the projection surface 111. More specifically, the light from the illuminants 12 are respectively projected at an upper side and a lower side of the projection surface 111, that is, the light emitted from the upper illuminant 12 is projected at the upper side of the projection surface 111, while the light emitted from the lower illuminant 12 is projected at the lower side of the projection surface 111. Preferably, the projection surface 111 has a width gradually decreased from down to up, which conforms to the shape of the flame and improve the imitation effect. In the present application, two projection surfaces 111, 111 are arranged on the front side and the rear side of the flame head body 11, respectively. Preferably, the projection surface 111 has a lower half that is provided with a strip-shaped projection layer 112 which is extended upward from a lower edge of the projection surface 111. The strip-shaped projection layer 112 can block a part of light from penetrating the flame head body 11, so that a black shadow of wick is generated on the lower side of the flame head body 11, thereby simulating the structure of a real lamp wick. Preferably, the projection layer 112 is black, and the upper end of the projection layer 112 is red, so as to simulate the real state of the lamp wick when the flame is burning, therefore, the imitation effect is improved.

In this embodiment, the two illuminants 12 are packaged in a lamp body to form a dual-chip LED. Each illuminant in the dual-chip LED has a chip for controlling the turn-on or turn-off of the illuminant 12, without using the control circuit board 4. Of course, the illuminants 12 can also use an ordinary three-pin single-spot LED and the control circuit board 4 to control the light emission.

The imitation flame lamp 100 also may include a remote control module and a receiving module for receiving signals from the remote control module, and the receiving module is electrically connected to the control circuit board 4.

The control circuit board 4 or the power supply 3 supplies power to the two illuminants 12, and the two illuminants 12 are lighted up intermittently under the control of their corresponding chips, so that the light from the illuminants 12 is projected to the projection surfaces 111 and located at the upper and lower positions of the projection surfaces 111. For example, under the condition that, the illuminant 12 located at the lower position is always turned on, while the illuminant 12 located at the upper position is turned off, the projection area of the light on the projection surfaces 111 becomes smaller; while the illuminant 12 located at the upper position is turned on, the projection area of the light on the projection surfaces 111 becomes larger. In such a way, the projection shadow on the projection surfaces 111 has a dynamic and varying effect, which looks like the burning flame.

In comparison with the prior art, the flame head body 11 of the present invention is provided with a projection surface 111, and two illuminants 12 respectively arranged up and down are arranged inside the flame head body 11, and the light from the illuminants 12 has an emitting direction facing toward the projection surface 111, so that a flame imitation effect can be shown on the projection surface 111. Furthermore, the flame imitation effect can be further improved by controlling the flicker of the two illuminants 12 to simulate the flame burning. In addition, it's unnecessary to use a traditional manner of using a driving mechanism to drive the flame sheet to swing, the flame head body 11 of the present application can be directly fixed, which simplifies the structure of the imitation flame component, the lamp holder and the driving mechanism, and the control is quite convenient and the cost is lowered.

Figure 4:
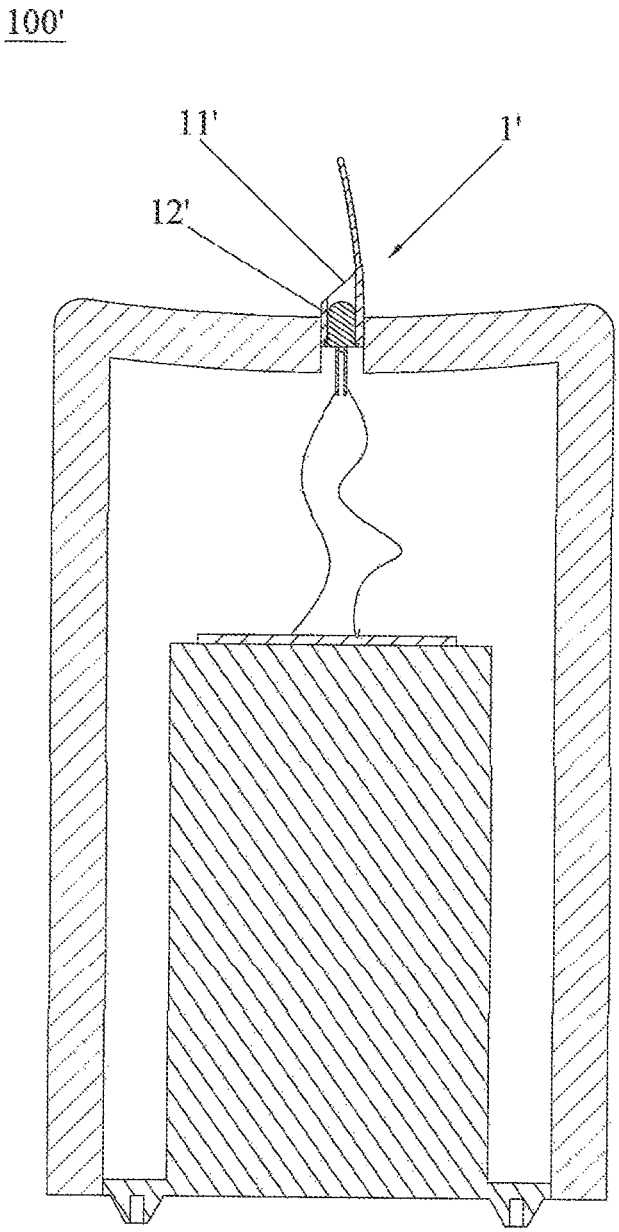
FIG. 4 is a schematic view of an imitation flame lamp according to a second embodiment of the present invention.
Figure 5:
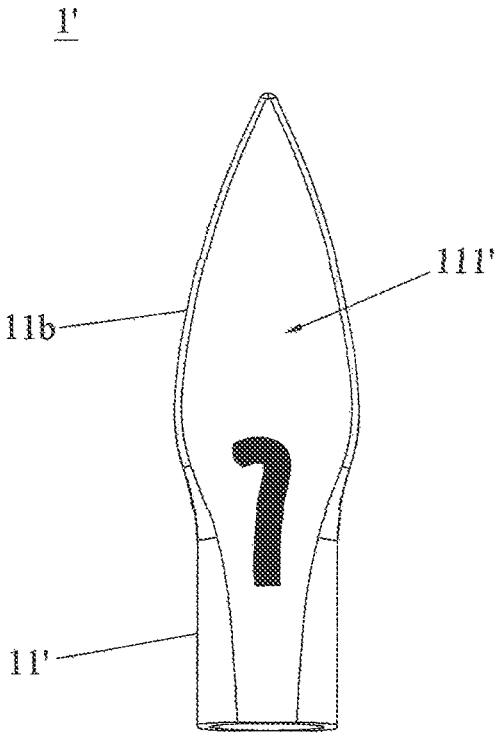
FIG. 5 schematic view of an imitation flame component according to a second embodiment of the present invention.
Figure 6:
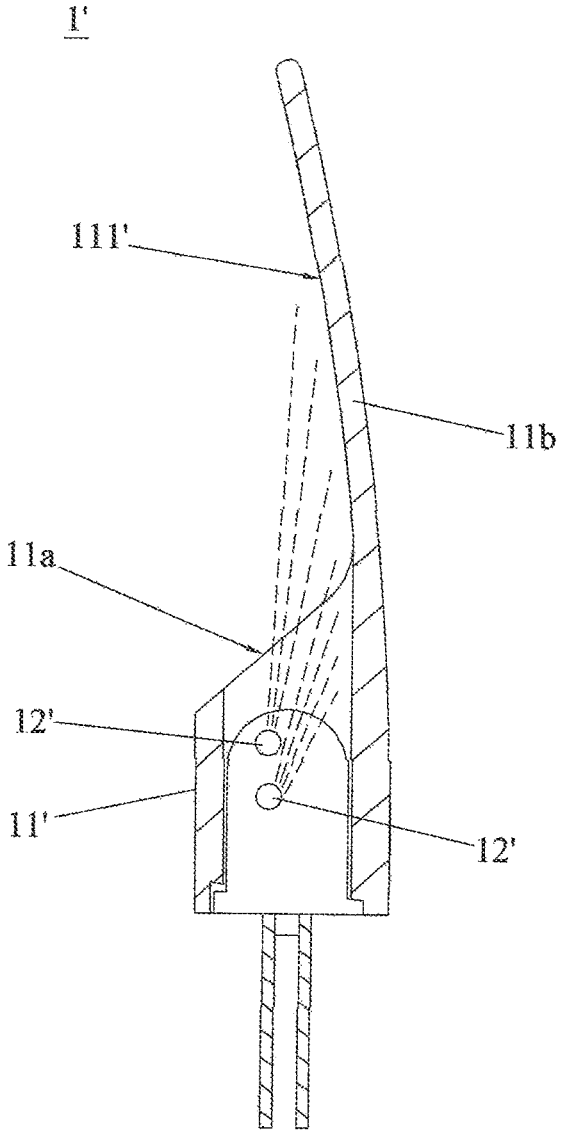
FIG. 6 is a sectional view of an imitation flame component according to a second embodiment of the present invention.

As shown in FIGS. 4 to 6, an imitation flame lamp 100' of the second embodiment of the present invention is shown. The basic structure of the imitation flame lamp 100' is substantially the same as that of the first embodiment. The difference is the structure of the flame head body 11' of the imitation flame component 1'. In this embodiment, the lower part of the flame head body 11' has a hollow cylindrical structure which has an upper opening 11*a*, and at least one side of the flame head body 11' is extended upward from the upper edge of the flame head body 11' to form a wall surface 11*b* on which the projection surface 111' is located. Specifically, the projection surface 111 is an inclined plane. The two illuminants 12' are configured in the cylindrical structure of the flame head body 11'. The structure and arrangement of the illuminants 12' are the same as those in the first embodiment. The light emitted from the two illuminants 12' passes through the upper opening 11*a* of the cylindrical structure and then is projected onto the projection surface 111'. In addition, the beneficial effects produced by the flame head body 11' and the imitation flame lamp 100' of the second embodiment are basically the same as those in the first embodiment, and detailed description is omitted here.

It should be noted that, the flicker control methods of the illuminants 12, 12' involved in the imitation flame lamp 100, 100' of the present invention are all well-known to those of ordinary skill in the art, and thus no detailed description is be given here.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An imitation flame component, comprising a flame head body with a hollow structure and at least two illuminants, wherein at least one side of the flame head body is provided with a projection surface for projecting light, the illuminants are configured inside the flame head body, the illuminants are arranged up and down respectively, and the light from the illuminants has an emitting direction facing toward the projection surface.

2. The imitation flame component according to claim 1, wherein the projection surface is a plane.

3. The imitation flame component according to claim 2, wherein the projection surface is inclined.

4. The imitation flame component according to claim 1, wherein the projection surface has a width gradually decreased from down to up.

5. The imitation flame component according to claim 1, wherein two projection surfaces are configured at a front side and a rear side of the flame head body, respectively.

6. The imitation flame component according to claim 1, wherein the projection surface has a lower half that is provided with a strip-shaped projection layer which is extended upward from a lower edge of the projection surface.

7. The imitation flame component according to claim 1, wherein the light from the illuminants are respectively projected at an upper side and a lower side of the projection surface.

8. The imitation flame component according to claim 1, wherein a lower end of the flame head body is provided with a connecting part.

9. The imitation flame component according to claim 1, wherein said at least one side of the flame head body is extended upward from an upper edge of the flame head body to form a wall surface on which the projection surface is located.

10. An imitation flame lamp, comprising a lamp holder body, a power supply, a control circuit board, and the imitation flame component according to claim 1, wherein the flame head body is fixed on the lamp holder body, the power supply and the control circuit board are configured into the lamp holder body, and the illuminants and the power supply are electrically connected to control circuit board, respectively.

* * * * *